US006508192B2

(12) United States Patent
Lentine

(10) Patent No.: US 6,508,192 B2
(45) Date of Patent: Jan. 21, 2003

(54) MARINE INSTRUMENT

(75) Inventor: Gregory E. Lentine, Orlando, FL (US)

(73) Assignee: Norcross Marine Products, Orlando, FL (US)

( * ) Notice: Subject to any disclaimer, the term of this patent is extended or adjusted under 35 U.S.C. 154(b) by 0 days.

(21) Appl. No.: 09/879,612

(22) Filed: Jun. 12, 2001

(65) Prior Publication Data

US 2002/0187691 A1 Dec. 12, 2002

(51) Int. Cl.[7] ..... B63B 49/00
(52) U.S. Cl. ..... 114/343; 248/27.1; 248/904
(58) Field of Search ..... 440/2; 114/343; 248/27.1, 904; 340/984; 73/431, 493

(56) References Cited

U.S. PATENT DOCUMENTS 4,759,216 A * 7/1988 Carpenter et al. ..... 73/182
4,920,799 A * 5/1990 Low ..... 248/27.1
5,237,951 A * 8/1993 Almeida ..... 114/382
5,841,359 A * 11/1998 Grilk ..... 340/438
6,179,253 B1 * 1/2001 Cotton ..... 248/27.1

* cited by examiner

*Primary Examiner*—Sherman Basinger
(74) *Attorney, Agent, or Firm*—Allen, Dyer, Doppelt, Milbrath & Gilchrist, P.A.

(57) ABSTRACT

A marine instrument includes a housing, a processor for processing an input signal comprising vessel navigation information, a substantially water resistant display connected to the processor, the display having at least one control switch extending outwardly from the display, a removable face plate having a window, a front surface, and a back surface, the removable face plate having at least one substantially flexible raised portion along the front surface forming a complementary concavity along the back surface, the face plate positioned on the display so that the concavity matingly receives therein the control switch, and so that the display is visible through the window, and a bezel connected to the housing so as to hold the removable face plate in place.

32 Claims, 3 Drawing Sheets

MARINE INSTRUMENT

FIELD OF THE INVENTION

The present invention relates to the field of marine instrumentation and, more particularly, to an instrument for display of vessel navigation information, especially water depth.

BACKGROUND OF THE INVENTION

Instruments for measuring parameters associated with vessel navigation, and for display of such information to the mariner are well known. Particularly useful is such an instrument for display of information related to the depth of the waters upon which a vessel navigates.

It is common practice for manufacturers of various vessel navigation instruments to apply to those instruments the trademarks and indicia of others who will sell the instruments at retail under their own house brands. However, it becomes cumbersome to manufacture various instruments under a number of different house brands, unless the manufacturer incorporates an easily changed component in the instrument which can bear the desired indicia.

SUMMARY OF THE INVENTION

With the foregoing in mind, the present invention advantageously provides a marine instrument having a removable face plate which allows for customizing the look of the instrument. The marine instrument comprises a housing; a processor positioned in the housing to process an input signal comprising vessel navigation information; a display positioned on the instrument face connected to the processor to display information processed from the input signal, the instrument face having at least one control switch extending outwardly from the face; a removable face plate having a display window, a front surface, and a back surface, the removable face plate having at least one substantially flexible raised portion along the front surface forming a complementary concavity along the back surface, so that when the face plate is positioned over the face of the instrument the concavity matingly receives therein the control switch, and so that the display is visible through the display window; and a bezel connected to the housing so as to hold the removable face plate thereon.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

Figure 1:
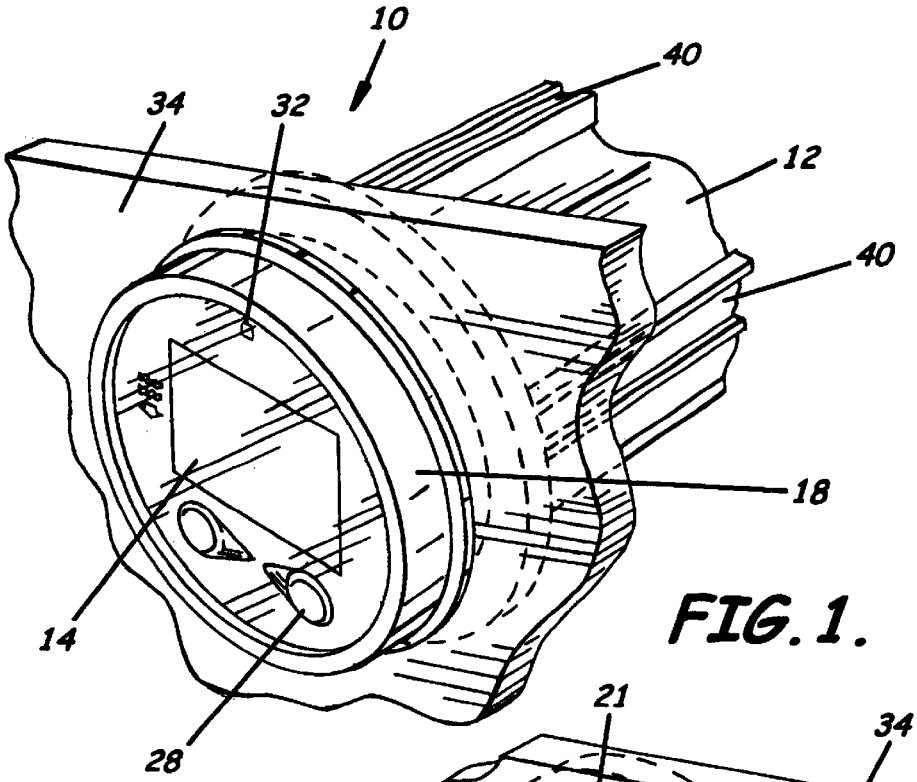
FIG. 1 illustrates a cutaway perspective view of the marine instrument according to an embodiment of the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

FIGS. 1 through 5 illustrate a marine instrument 10 having an instrument face for thereon displaying vessel navigation information. The instrument 10 comprises a housing 12, a processor 13 positioned in the housing to process an input signal comprising vessel navigation information, a display 14 positioned on the instrument face connected to the processor to display information processed from the input signal, a removable face plate 16 positioned on the instrument face over the display, and a bezel 18 connected to the housing so as to hold the removable face plate in place on the instrument face. The display 14 has at least one control switch 20 extending outwardly from the display, and is substantially water resistant, and preferably waterproof. The marine instrument 10 includes an alarm 19 responsive to the input signal. The alarm may include an audible alarm, and preferably includes a visual alarm indicator 21, preferably positioned on the face of the instrument so as to be visible to a mariner navigating the vessel.

Figure 2:
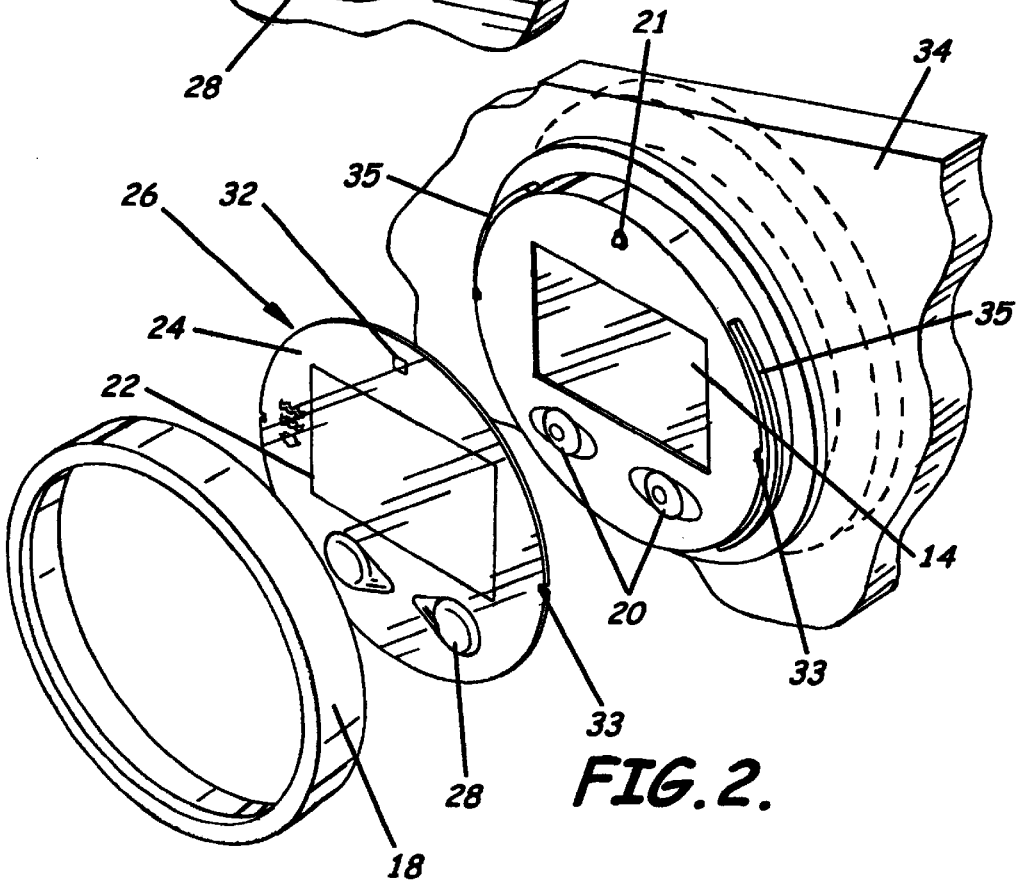
FIG. 2 shows an exploded view of the instrument of FIG. 1.
Figure 3:
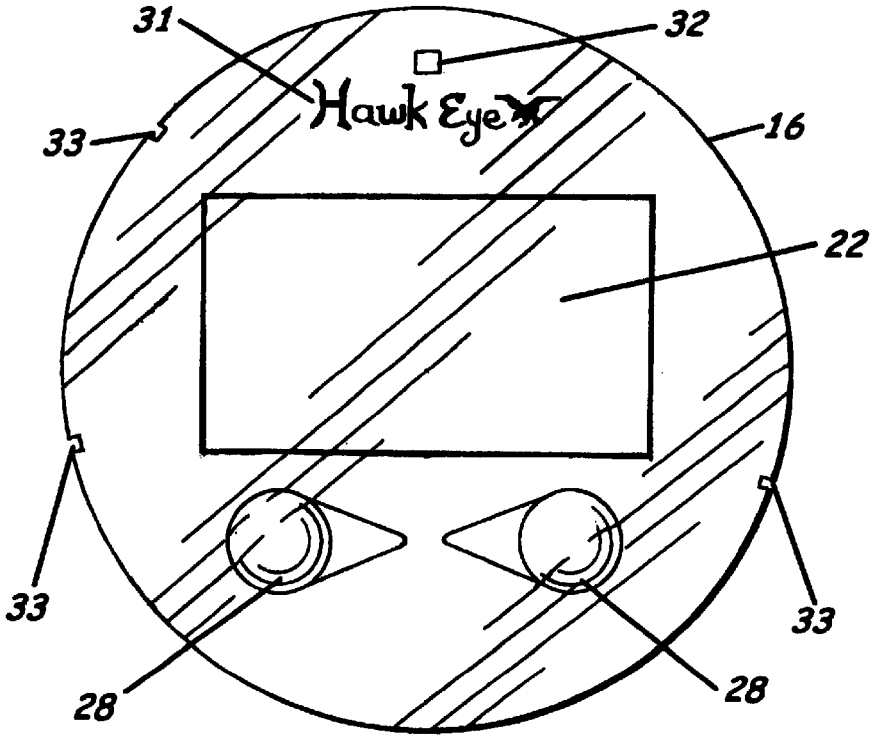
FIG. 3 is a front elevation view of the removable face plate of the instrument of FIG. 1.
Figure 4:
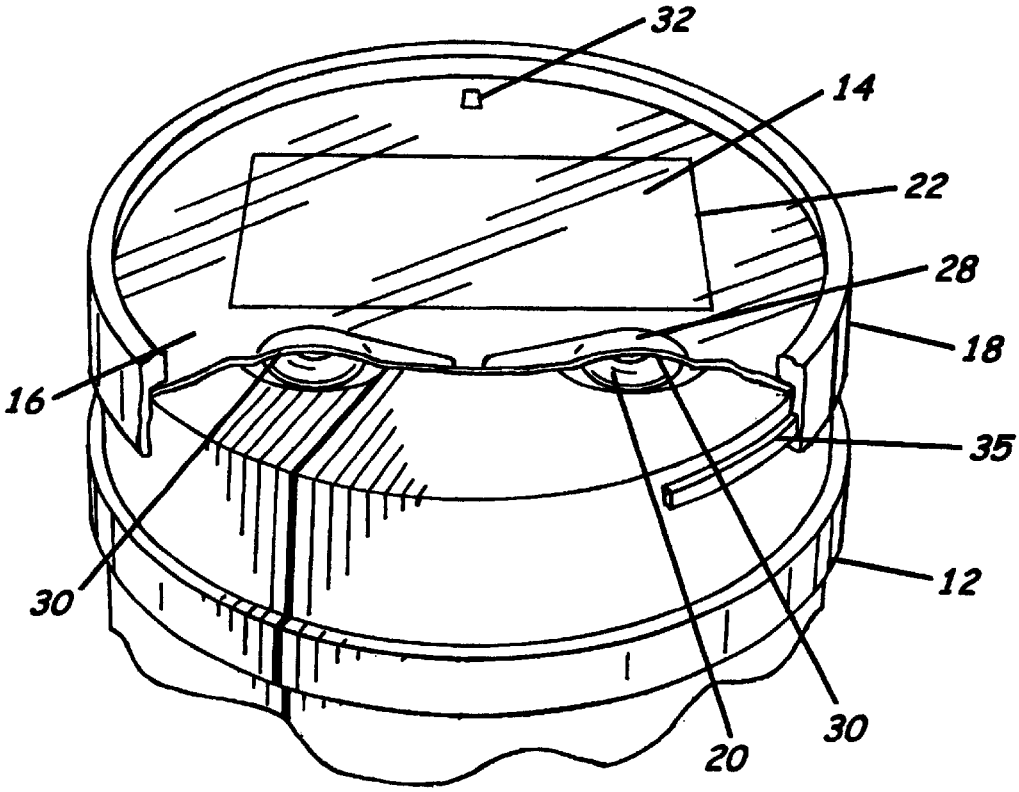
FIG. 4 shows a cutaway side perspective view of the instrument of FIG. 1, illustrating the relationship between the bezel, face plate, display and control switch.

The removable face plate 16, best shown in FIGS. 2–4, includes a window 22, a front surface 24, and a back surface 26, and has at least one substantially flexible raised portion 28 along the front surface forming a complementary concavity 30 along the back surface. In a preferred embodiment, the face plate 16 also includes a visual alarm window 32 allowing the visual alarm 21 to be visible therethrough. The face plate 16 is positioned on the instrument face over the display 14 so that the concavity 30 along its back surface matingly receives therein the control switch 20 extending outwardly from the instrument face, and so that the display 14 is visible through the window 22. The removable face plate 16 provides a manufacturing advantage in allowing for easy application of a predetermined house brand or other specific indicia 31 to the face plate, so that by substituting the desired face plate the instrument may be customized for retail sale.

The input signal in another embodiment of the invention comprises a plurality of vessel navigation information, and control switch 20 selects the information to be displayed from the plurality of vessel navigation information. In this embodiment, the plurality of vessel navigation information is selected from water depth, vessel speed, water temperature, water chemistry parameters, time of day, elapsed time, countdown timer, and geographic positioning coordinates, all useful in navigating a vessel.

The instrument 10 also preferably comprises user adjustable measurement units for displaying water depth information. Additionally, the present marine instrument 10 includes an alarm having user adjustable parameters for providing a warning responsive to an input signal. The alarm may be responsive to water depth. The alarm preferably comprises audible and visual alarms.

The display 14 and the face plate 16 preferably include complementary aligners 33 for properly aligning the face plate with the display. The skilled will understand that various structural features may be employed as complementary aligners, for example, an array of tabs and slots. Other similar aligners will be known to the skilled artisan, however, and are intended to be included in the invention.

The bezel 18, best shown in FIGS. 2 and 4, may connect to the housing 12 in a variety of known ways. Preferably, bezel 18 connects to the housing 12 through a twist lock mechanism 35 also known as a bayonet mount, although a screw type mount could also be used. Additionally, it would be desirable to color coordinate the bezel 18 to a mounting position for the instrument on a vessel. For example, as shown in FIGS. 1 and 2 typically, the instrument is suitable for through bulkhead 34 mounting by cutting a hole of an appropriate size in the bulkhead, and positioning the instrument through the hole so that the display is visible to a mariner from a front surface of the bulkhead. In this type of mounting any connecting wires extend from the instrument along a back surface of the bulkhead 34. In such a mounting, color coordination of the bezel 18 could mean that the vessel owner requested that the part of the instrument which is visible to the user be the same color as the bulkhead 34. On the other hand, color coordination could also mean that the vessel owner requested a predetermined bezel 18 color contrasting with that of the bulkhead 34, for added visibility of the instrument The removable face plate 16 may also be color coordinated to a mounting position on a vessel.

Figure 5:
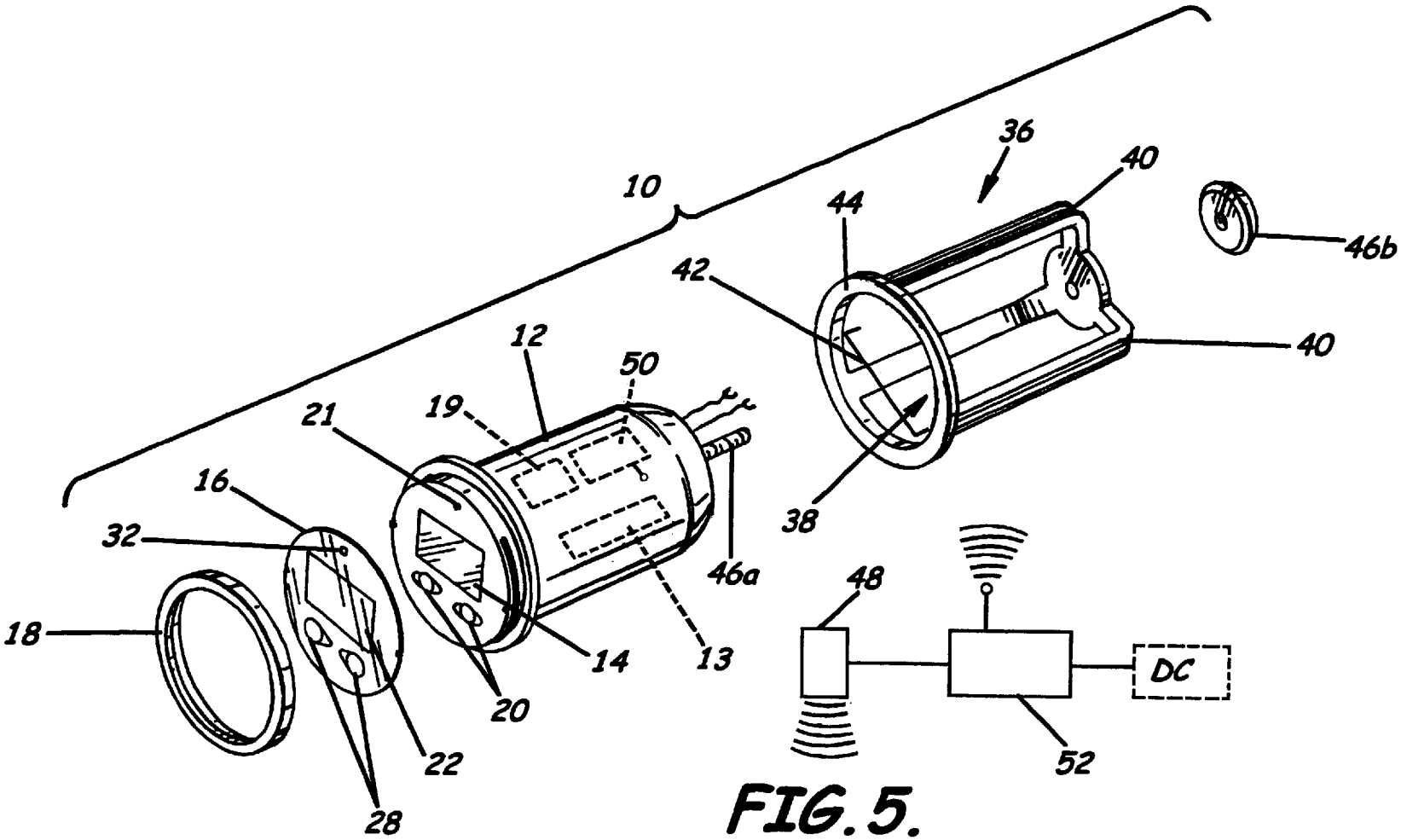
FIG. 5 is an exploded perspective view of the instrument of FIG. 1, including the mounting bracket.

The marine instrument 10 of the present invention includes a mounting bracket 36, shown in FIG. 5, for through bulkhead 34 mounting of the Instrument. The mounting bracket 36 is best illustrated in FIG. 5, and generally comprises a receptacle 38 having an inner cavity dimensioned for therein receiving the housing 12, the cavity being defined by at least one plurality of peripheral members 40, and a mouth opening 42 providing access to the inner cavity. Additionally, the bracket 36 includes a flange 44 positioned along the mouth opening 42 to support the mounting bracket adjacent an opening cut in a bulkhead 34 for therethrough mounting the marine instrument 10. The term "flange" is intended to include its common meaning, such as a protruding rim, edge, rib, or collar used to strengthen an object, hold it in place, or attach it to another object. The skilled, however, will recognize that mounting members other than flange 44 may be substituted in the invention to perform the same function of supporting the mounting bracket adjacent an opening cut through the bulkhead. The mounting bracket 36 may also include a fastener 46A for fastening the instrument housing 12 to the mounting bracket, the fastener preferably comprising a threaded connector and nut 46B, as shown in FIG. 5.

The present invention additionally includes the marine instrument in combination with a transducer positioned on a vessel for generating a signal containing water depth information, the transducer 48 connected to transmit the signal to the processor. The marine instrument 10, in an additional embodiment of the invention, further comprises a receiver 50 connected to the processor for receiving an input signal by wireless transmission from a sending unit 52, eliminating the need for connecting wires.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A marine instrument having an instrument face, and comprising:

a housing;

a processor positioned in said housing to process an input signal comprising water depth information;

a display positioned on the instrument face connected to said processor to display information processed from the input signal;

at least one control switch connected to control said display and extending outwardly from the instrument face;

a removable face plate having a window, a front surface, and a back surface, said removable face plate having at least one substantially flexible raised portion along the front surface forming a complementary concavity along the back surface, said face plate positioned over the instrument face so that the concavity matingly receives therein the control switch, and so that the display is visible through the display window; and a bezel connected to said housing so as to hold said removable face plate on the instrument face in a alignment over said display.

2. The marine instrument of claim 1, wherein said face plate comprises at least one indicium on the front surface.

3. The marine instrument of claim 1, further comprising complementary aligners properly aligning said face plate with the instrument face.

4. The marine instrument of claim 1, wherein said bezel connects to said housing by a twist-lock mount.

5. The marine instrument of claim 1, wherein said bezel comprises a predetermined color coordinated to a mounting position on a vessel.

6. The marine instrument of claim 1, wherein said face plate comprises a predetermined color coordinated to a mounting position on a vessel.

7. The marine instrument of claim 1, further including a mounting bracket for through bulkhead mounting of the instrument, said mounting bracket comprising:

a receptacle having an inner cavity dimensioned for therein receiving said housing, said cavity defined by at least one peripheral member, and a mouth opening providing access to the inner cavity; and a flange positioned along the mouth opening to support the mounting bracket adjacent an opening cut into a bulkhead for therethrough mounting said marine instrument.

8. The marine instrument of claim 7, further comprising a fastener for fastening the housing to the mounting bracket.

9. The marine instrument of claim 8, wherein said fastener comprises a threaded connector.

10. The marine instrument of claim 1, in combination with a transducer positioned on a vessel for generating said signal, and connected to transmit the signal to said processor.

11. The marine instrument of claim 1, further comprising a receiver connected to said processor for receiving said input signal by wireless transmission.

12. The marine instrument of claim 1, further comprising an alarm having user adjustable parameters for providing a warning responsive to water depth.

13. The marine instrument of claim 12, wherein said alarm comprises a visual alarm.

14. The marine instrument of claim 13, wherein said face plate further comprises a visual alarm window allowing said visual alarm to be visible therethrough.

15. The marine instrument of claim 1, further comprising user adjustable measurement units for displaying water depth information.

16. A marine instrument having an instrument face, and comprising:

a housing;

a processor positioned in said housing to process an input signal comprising vessel navigation information;

a water resistant display connected to said processor to display information processed from the input signal;

at least one control switch connected to control said display and extending outwardly from the instrument face;

a removable face plate having a display window, a front surface, a back surface, and having at least one substantially flexible raised portion along the front surface forming a complementary concavity along the back surface, said face plate positioned over the instrument face so that the concavity matingly receives therein the control switch, and so that the display is visible through the display window; and a bezel connected to said housing so as to hold said removable face plate on the instrument face in alignment over said display.

17. The marine instrument of claim 16, wherein said input signal comprises a plurality of vessel navigation information, and said control switch selects information to be displayed from the plurality of vessel navigation information.

18. The marine instrument of claim 16, wherein said plurality of vessel navigation information is selected from water depth, vessel speed, water temperature, water chemistry parameters, time of day, elapsed time, countdown timer, and geographic positioning coordinates.

19. The marine instrument of claim 16, wherein said face plate comprises at least one indicium on the front surface.

20. The marine instrument of claim 16, further comprising complementary aligners properly aligning said face plate with the instrument face.

21. The marine instrument of claim 16, wherein said bezel connects to said housing by a twist-lock mount.

22. The marine instrument of claim 16, wherein said bezel comprises a predetermined color coordinated to a mounting position on a vessel.

23. The marine instrument of claim 16, wherein said face plate comprises a predetermined color coordinated to a mounting position on a vessel.

24. The marine instrument of claim 16, further comprising a mounting bracket for through bulkhead mounting of the instrument, said mounting bracket comprising:

a receptacle having an inner cavity dimensioned for therein receiving said housing, said cavity defined by at least one peripheral member, and a mouth opening providing access to the inner cavity; and a flange positioned along the mouth opening to support the mounting bracket adjacent an opening cut into a bulkhead for therethrough mounting said marine instrument.

25. The marine instrument of claim 24, further comprising a fastener for fastening the housing to the mounting bracket.

26. The marine instrument of claim 25, wherein said fastener comprises a threaded connector.

27. The marine instrument of claim 16, in combination with a transducer positioned on a vessel for generating a signal containing water depth information, said transducer connected to transmit the signal to said processor.

28. The marine instrument of claim 16, further comprising a receiver connected to said processor for receiving said input signal by wireless transmission from a sending unit.

29. The marine instrument of claim 16, further comprising an alarm having user adjustable parameters for providing a warning responsive to said input signal.

30. The marine instrument of claim 29, wherein said alarm comprises a visual alarm.

31. The marine instrument of claim 30, wherein said face plate further comprises a visual alarm window allowing said visual alarm to be visible therethrough.

32. The marine instrument of claim 16, further comprising user adjustable measurement units for displaying water depth information.

* * * * *